US006427636B1

(12) United States Patent
Liebig

(10) Patent No.: US 6,427,636 B1
(45) Date of Patent: Aug. 6, 2002

(54) METHOD AND PLANT FOR HEATING A LIQUID MEDIUM

(75) Inventor: Erhard Liebig, Laufenburg (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 10/067,307

(22) Filed: Feb. 7, 2002

Related U.S. Application Data

(62) Division of application No. 09/572,308, filed on May 18, 2000.

(30) Foreign Application Priority Data

Jun. 9, 1999 (DE) ..... 199 26 326

(51) Int. Cl.[7] ..... F22B 33/00

(52) U.S. Cl. ..... 122/1 R; 122/1 B; 122/1 C; 122/7 R; 122/235.29; 122/406.1; 122/406.3; 122/406.4

(58) Field of Search ..... 122/1 R, 1 B, 122/1 C, 7 R, 406.1, 406.3, 406.4, 406.5, 235.11, 235.29

(56) References Cited

U.S. PATENT DOCUMENTS 2,124,254 A * 7/1938 Ledinegg ..... 122/31.1
3,250,259 A 5/1966 Profos
3,719,172 A 3/1973 Charcharos et al.
3,965,675 A 6/1976 Martz et al.
4,080,789 A * 3/1978 Frei ..... 122/406.5
6,152,085 A * 11/2000 Dethier et al. ..... 122/235.29

FOREIGN PATENT DOCUMENTS

DE 4303613 A1 8/1994
DE 4441008 A1 5/1996

* cited by examiner

*Primary Examiner*—Jiping Lu
(74) *Attorney, Agent, or Firm*—Burns, Doane, Swecker & Mathis, L.L.P.

(57) ABSTRACT

The invention relates to a method of heating a liquid medium by means of a first thermal system (2, 3, 4, 7, 12, 13) and at least one second thermal system (5, 6, 6A, 15, 16) following said first thermal system (2, 3, 4, 7, 12, 13), which thermal systems each have at least one heat exchanger (2, 5) through which the medium flows, and which second thermal system (5, 6, 6A, 15, 16) is operated at a higher temperature level than the first thermal system (2, 3, 4, 7, 12, 13). The method is characterized in that, for the accelerated raising of the temperature of the medium in the first thermal system (2, 3, 4, 7, 12, 13), the direct feed of the medium to the same is reduced and in the extreme case prevented, and in that medium flowing through the first thermal system (2, 3, 4, 7, 12, 13) is directed in a circuit. The invention also relates to a plant for carrying out the method.

17 Claims, 5 Drawing Sheets

METHOD AND PLANT FOR HEATING A LIQUID MEDIUM

This application is a divisional application of copending U.S. patent application Ser. No. 09/572,308 filed on May 18, 2000.

FIELD OF THE INVENTION

The present invention relates to a method of heating a liquid medium by means of a first thermal system and at least one second thermal system following said first thermal system, which thermal systems each have at least one heat exchanger through which the medium flows, and which second thermal system is operated at a higher temperature level than the first thermal system. It also relates to a plant for carrying out the method, including a feed line for feeding the medium to be heated.

BACKGROUND OF THE INVENTION

Plants in which a liquid medium passes through a plurality of thermal systems in order to be heated, possibly evaporated, are present, for example, in boilers which are heated by flue gas from burners or exhaust gas from gas turbines.

The medium may be water, having additives if need be. Depending on the final load, the water is heated in the boiler to a predetermined temperature in order to be fed, for example, to an industrial plant, a hot-water network, etc., or evaporated in order to be fed, for example, to a steam turbine or an industrial steam load.

The first thermal system in such a boiler, which has a first heat exchanger, a heating-area bank, is normally called the economizer. Due to the temperature conditions, the economizer, which is provided for preheating the feed water in the boiler, preferably works on the flue-gas-side or exhaust-gas-side end of the boiler, i.e. at comparatively low temperatures.

On the other hand, the temperature difference between the flue gas or exhaust gas and the feed water to be heated is relatively small. This in turn results in large heating areas and large heating-area masses associated therewith.

Consequently, an economizer requires a considerable amount of time for adaptation of the temperature, for example during a change in the operational conditions. Furthermore, it is known that there is a risk of dew-point corrosion on account of the temperatures and pressures prevailing in the economizer.

Known methods of raising the feed-water temperature at the boiler inlet or for avoiding dew-point corrosion at the flue-gas-side boiler end, for example as a function of the fuel used, are recirculation and bypassing the economizer.

In the case of recirculation, water preheated at the boiler inlet is admixed with the feed water. For the bypassing of the economizer, the feed water bypasses the economizer, and the preheating is carried out in a system working at a higher temperature level, for example a steam-generating system, at the cost of the reduction in the steam generation.

In order not to damage the heating areas, in particular during the start-up or during a change to a sulfurous fuel, measures which go beyond the said measures, i.e. which permit markedly quicker temperature raising in the economizer region, are necessary.

SUMMARY OF THE INVENTION

The object of the invention is therefore to provide a method of heating a liquid medium by means of a first thermal system and a second thermal system following said first thermal system and having a higher temperature level, according to which method accelerated raising of the temperature of the first thermal system is made possible under special operating conditions (start-up, fuel change). Furthermore, the risk of dew-point corrosion is to be reduced.

According to the invention, this is achieved in that, for the accelerated raising of the temperature of the medium in the first thermal system, the direct feed of the medium to the same is reduced and in the extreme case prevented, and in that medium flowing through the first thermal system is directed in a circuit.

A plant for carrying out the method according to the invention includes the first thermal system which has a first heat exchanger. The first heat exchanger has an inlet line adjoining the feed line, and an outlet line which runs through a line section to the second thermal system. A first control element is arranged between the feed line and the inlet line. A bypass line, which is equipped with a second control element, runs from the feed line to the outlet line. In addition, a line section runs from the outlet line to the second thermal system. The outlet line is connected to the inlet line through a recirculation line, which has a third control element and a first pump. The recirculation line is arranged paralleel to the first heat exchanger.

BRIEF DESCRIPTION OF THE DRAWINGS

Various circuit arrangements for explaining various embodiments of the invention are shown in a simplified form in the drawing figures. Only the elements essential for the understanding of the invention are shown.

DETAILED DESCRIPTION OF THE INVENTION

A section of a boiler is used as an exemplary embodiment for explaining the invention. This section is to have a first thermal system and a second thermal system, the second thermal system being operated at a higher temperature level than the first thermal system.

In concrete terms, in the exemplary embodiments shown, the first thermal system comprises the economizer and the second thermal system comprises the evaporator of the boiler. In this case, for the idea behind the invention, it is irrelevant whether the evaporator is a drum circulation evaporator or a once-through evaporator, as becomes apparent from the examples described below.

Further exemplary embodiments have a second preheating stage with tank as second thermal system.

The following figures, methods and explanations are in principle based on one another.

Figure 1:
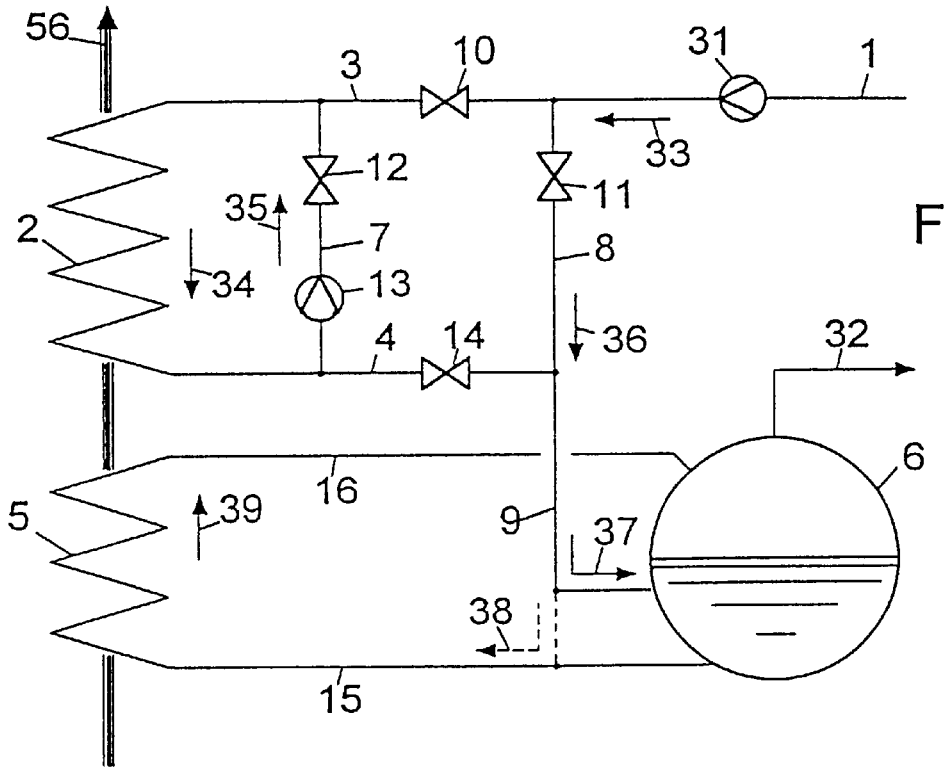
FIG. 1 shows a circuit arrangement in a first embodiment of the invention, having a drum circulation evaporator as a second thermal system.

Reference is now made to the first embodiment according to FIG. 1 having a drum circulation evaporator as a second thermal system. The reference numeral 1 designates the feed-water line through which the medium is to be heated, i.e. prepared feed water, is fed. The feed water is delivered to the boiler by the feed-water pump 31. The feed-water line 1 ends at a first control element 10. Downstream of the first control element 10, an inlet line 3 runs to a first heat exchanger 2 (the economizer), which is followed by an outlet line 4. The line section 9 leads as an extension of the outlet line 4 to the second thermal system, in the actual case to the steam drum 6.

Upstream of the first control element 10, a bypass line 8 having a second control element 11 branches off from the feed-water line 1 to the outlet line 4.

A recirculation line 7 having a first pump 13 and a third control element 12 extends between the outlet line 4 and the inlet line 3, in which case it can be seen from the drawing figure that the first pump 13 is arranged for delivery from the outlet line 4 to the inlet line 3. Downstream of the branching point of the recirculation line 7 from the outlet line 4, a fourth control element 14 is arranged in the outlet line 4.

The second thermal system comprises a second heat exchanger 5, the exemplary evaporator, which is connected to a tank for receiving a quantity of the medium in the liquid state, here in concrete terms to a steam drum 6. From the steam drum 6, a supply line 15 leads to the second heat exchanger 5. From the second heat exchanger 5, a return line 16 leads to the steam drum 6. The reference numeral 32 designates an outlet line of the steam drum 6, this outlet line leading, for example, to a steam load, a steam turbine, a superheater, etc.

The two heat exchangers 2, 5 are heated by a heating gas 56, which may be flue gas in the case of a boiler fired by burners or exhaust gas in the case of the waste-heat utilization of a gas turbine.

The heating of the heat exchangers 2, 5 is identical in all the exemplary embodiments and is therefore not explained again.

During normal operation of the two thermal systems, the first control element 10 and the fourth control element 14 are open, and the second control element 11 and the third control element 12 are closed. Furthermore, the first pump 13 is shut down.

The water flowing in the direction of arrow 33 through the feed-water line 1 therefore flows through the inlet line 3 to the first heat exchanger 2, the economizer, from the latter through the outlet line 4 and its extension, the line section 9, into the steam drum 6 or alternatively into the supply line 15, as indicated by dash-lined arrow 38.

From the steam drum 6, the water flows through the supply line 15 to the second heat exchanger 5, the evaporator, and the steam or the water/steam mixture flows from the second heat exchanger 5 through the return line 16 back to the steam drum 6. Water and steam are separated in the steam drum 6. Finally, the steam flows through the outlet line 32 to a load.

The circulation or pass in the second thermal system may be effected by natural flow, by a pump or by a combination of both methods.

For the accelerated raising of the temperature in the first heat exchanger 2, for example during the start-up of the plant, the first control element 10 and the fourth control element 14 are at least partly closed—in the extreme case completely closed. The second control element 11 and the third control element 12 are at least partly opened—in the extreme case completely opened. The pump 13 is in operation.

The water to be heated therefore flows in the circuit, in the extreme case, with control elements completely closed and open respectively, in a completely closed circuit, in the direction of arrow 34 from the cold end to the hot end of the first heat exchanger 2, through the outlet line 4 to the recirculation line 7, flows in the direction of arrow 35 through the same, then to the inlet line 3 and finally back to the cold end of the first heat exchanger 2.

Consequently, unused and thus "cold" feed water is not constantly fed to the cold end of the heat exchanger 2 via the feed-water line 1, but rather heated water already flowing in from the hot end of the heat exchanger 2 is fed to the cold end. Quicker heating not only of the water but also of the heating-area mass of the first heat exchanger 2 is thus effected.

Since the control elements 10, 14 are closed and the control element 11 of the bypass line 8 is in the open position, the water flows from the feed-water line 1 in the direction of arrow 36 through the bypass line 8 and the line section 9 to the second thermal system.

In this case, two variants are possible:

As indicated by arrow 37, the water can flow via the line section 9 directly into the steam drum 6.

As indicated by dash-lined arrow 38, the water can flow via the line section 9 into the supply line 15.

For reasons of clarity, any fittings assigned to the flow variants according to arrows 37 or 38 are not shown.

It may be noted that the respective control elements need not necessarily be in a completely closed or completely open position. Intermediate positions are also possible in order to achieve the best possible effect. Controlled movements from one position into the other position are also envisaged, for example in order to avoid thermal shocks.

Figure 2:
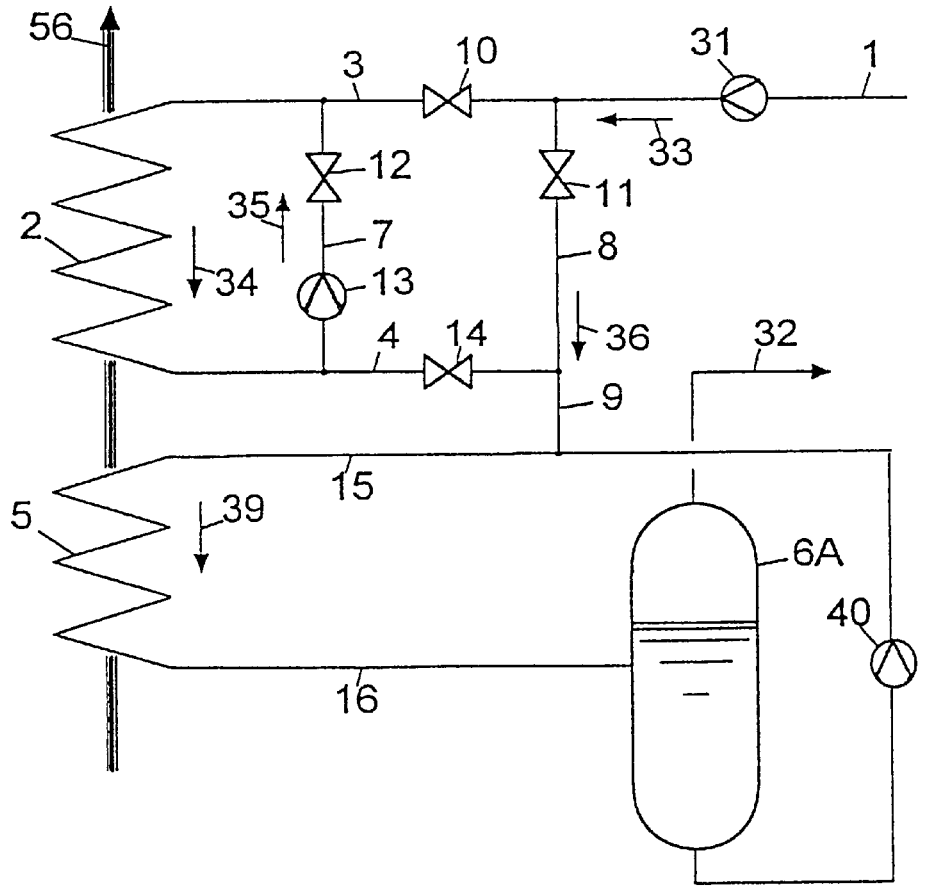
FIG. 2 shows a circuit arrangement identical to that of FIG. 1, but having a once-through evaporator as a second thermal system.

With regard to the first thermal system, the exemplary embodiment shown in FIG. 2 is identical to the exemplary embodiment according to FIG. 1.

The second thermal system is a once-through evaporator, consisting of the second heat exchanger, the evaporator 5, the supply line 15 and return line 16 connected to the evaporator 5, and a separator 6A.

Unlike the variant of a drum circulation evaporator shown in FIG. 1, the flow through the second thermal system takes place through the line section 9 into the supply line 15, in the direction of arrow 39 through the evaporator 5 and via the return line 16 into the separator 6A.

Water and steam are separated in the separator 6A. The steam flows via the outlet line 32 to a steam load or superheater. The water separated in the separator is fed back to the evaporator 5 via the supply line 15 having the circulation pump 40.

The operation of the first thermal system then, both during normal operation and during the operation for the accelerated raising of the temperature, is completely identical to that according to FIG. 1.

A second embodiment of the invention is described below with reference to FIG. 3, in which case, as an embodiment variant, a drum circulation evaporator having the steam drum 6 is again used as second thermal system. As far as possible, the same reference numerals as in FIGS. 1 and 2 are used.

The feed-water line 1 having the feed-water pump 31, through which the feed water flows in the direction of arrow 33, runs to the first thermal system, which again has, in particular, a first heat exchanger 2 having an inlet line 3 and an outlet line 4, a first control valve 10, a fourth control valve 14, and a recirculation line 7 having a first pump 13 and a third control element 12.

A bypass line 8 having a second control element 11 branches off from the feed-water line 1, which bypass line 8 runs to the outlet line 4. The line section 9 leads as an extension of the outlet line 4 to the second thermal system, in the actual case to the steam drum 6. The second thermal system has, in particular, a steam drum 6 with an outlet line 32 and a second heat exchanger 5, which is connected to the steam drum 6 via a supply line 15 and a return line 16.

Figure 3:
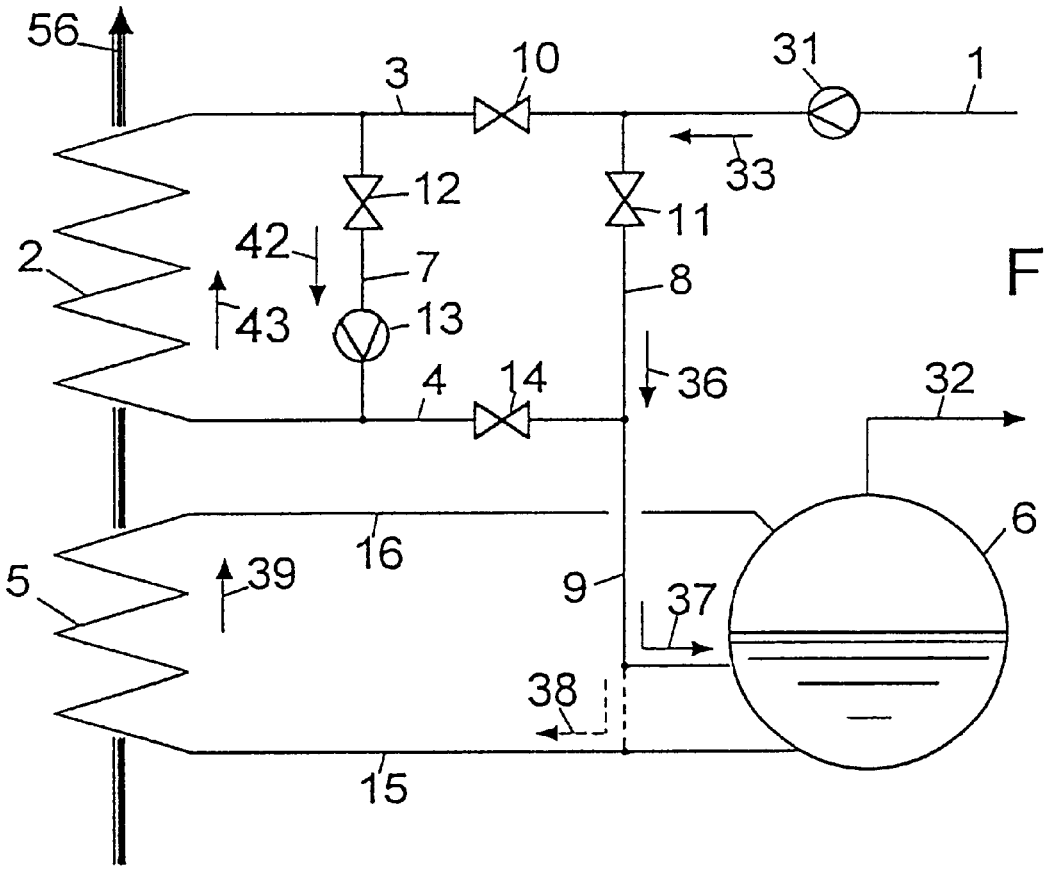
FIG. 3 shows a circuit arrangement in a second embodiment of the invention, having a drum circulation evaporator as a second thermal system.

The difference between this second embodiment according to FIG. 3 and the embodiment according to FIGS. 1 and 2 lies in the arrangement of the pump 13 in the recirculation line 7.

For the accelerated raising of the temperature in the first heat exchanger 2, for example during the start-up of the plant, the first control element 10 and the fourth control element 14 are at least partly closed—in the extreme case completely closed. The second control element 11 and the third control element 12 are at least partly opened—in the extreme case completely opened—and the pump 13 is put into operation.

In this embodiment, the water to be heated flows in the circuit in the direction of arrow 43 from the hot end to the cold end of the first heat exchanger 2, through the inlet line 3 to the recirculation line 7, flows in the direction of arrow 42 through the latter, then to the outlet line 4 and finally back to the hot end of the first heat exchanger 2.

The flow in the second thermal system according to FIG. 3 is the same as the flow in the second thermal system of the embodiment according to FIG. 1.

Figure 4:
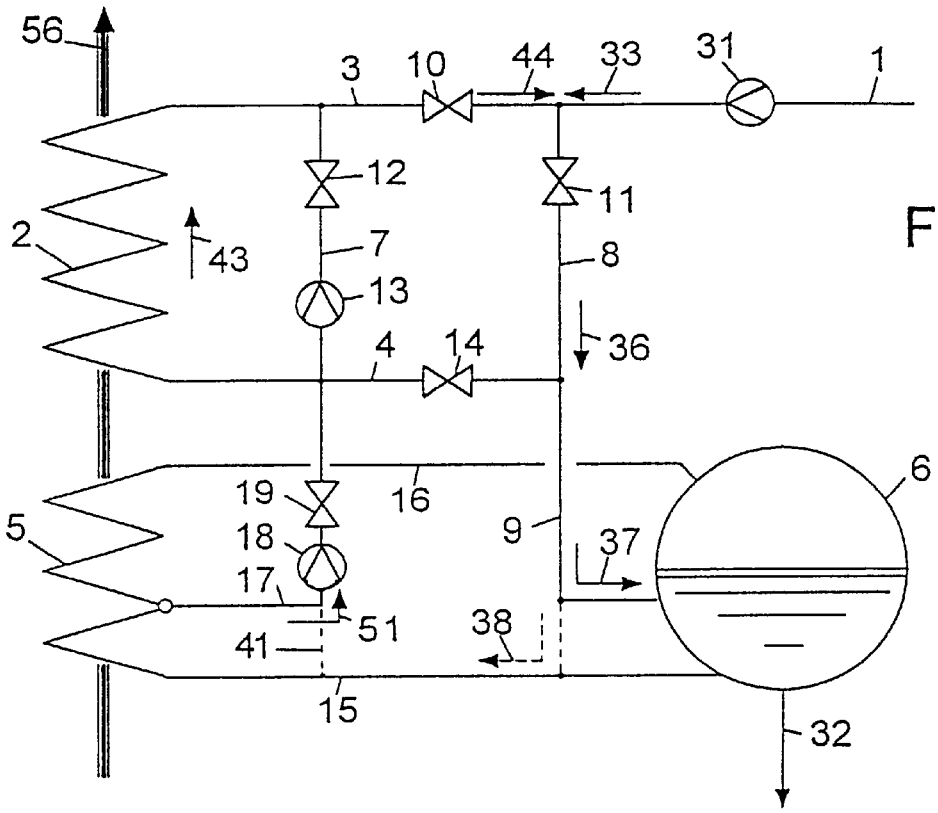
FIG. 4 shows a circuit arrangement in a third embodiment of the invention, having a second preheating stage with a tank as a second thermal system.

FIG. 4 shows a third embodiment, a second preheating stage having a second heat exchanger 5 and a tank 6 being used as embodiment variant for the second thermal system. As far as possible, the same reference numerals as in the preceding embodiments have been used.

The feed-water line 1 having the feed-water pump 31, through which the feed water flows in the direction of arrow 33, runs to the first thermal system, which again has, in particular, a first heat exchanger 2 having an inlet line 3 and an outlet line 4, a first control valve 10, a fourth control valve 14, and a recirculation line 7 having a first pump 13 and a third control element 12.

A bypass line 8 having a second control element 11 branches off from the feed-water line 1, which bypass line 8 runs to the outlet line 4. The line section 9 leads as an extension of the outlet line 4 to the second thermal system, in the actual case to the tank 6. The second thermal system has, in particular, a tank 6 with an outlet line 32 and a second heat exchanger 5, which is connected to the tank 6 via a supply line 15 and a return line 16.

The feed water flowing into the tank 6 via the line section 9 in the direction of arrow 37 may alternatively also flow into the supply line 15, as indicated by dash-lined arrow 38.

In this embodiment, a line 17 having a pump 18 and a control element 19 runs from the second heat exchanger 5 to the hot end of the first heat exchanger 2 or to the outlet line 4.

In a second variant, which is depicted by a dashed line, a line 41, which merges into the line 17, branches off from the supply line 15.

For the accelerated raising of the temperature in the first heat exchanger 2, for example during the start-up of the plant, the first control element 10, the second control element 11 and the control element 19 are in the open position. The third control element 12 and the fourth control element 14 are in the closed position. The first pump 13 in the recirculation line 7 is shut down.

The feed water flowing in through the feed-water line 1 in the direction of arrow 33 flows through the bypass line 8 in the direction of arrow 36 and through the line section 9 directly into the second thermal system, either into the tank 6, as shown by arrow 37, or alternatively into the supply line 15, as shown by dash-lined arrow 38.

From the second heat exchanger 5, the water flows in the direction of arrow 51 through the line 17 into the outlet line 4 and to the hot end of the first heat exchanger 2. Furthermore, the water flows in the direction of arrow 43 from the hot end to the cold end of the first heat exchanger 2 and then to the inlet line 3.

At the end of the inlet line 3, this water flow, as shown by arrow 44, is mixed with the feed-water flow flowing in through the feed-water line 1, whereupon both water flows flow together through the bypass line 8 and the line section 9 to the second thermal system, i.e. to the tank 6 or to the supply line 15. Thus a circuit comprising both thermal systems is formed.

In the second variant, water can flow out of the supply line 15 via the line 41 into the line 17.

It is now also possible to run the plant according to FIG. 4 in accordance with the plant according to FIG. 1 by the control elements 10, 14, 19 being closed, the control elements 11 and 12 being open, the first pump 13 being put into operation and the pump 18 being shut down.

That is to say that it is possible with this embodiment to carry out a start-up in two phases, namely during a first phase according to the method which is possible with the arrangement according to FIG. 1, and during a second phase according to the method which is possible with the arrangement described first according to FIG. 4, or vice versa.

This is intended to illustrate that the exemplary embodiments described may of course also be used in any desired combinations.

Figure 5:
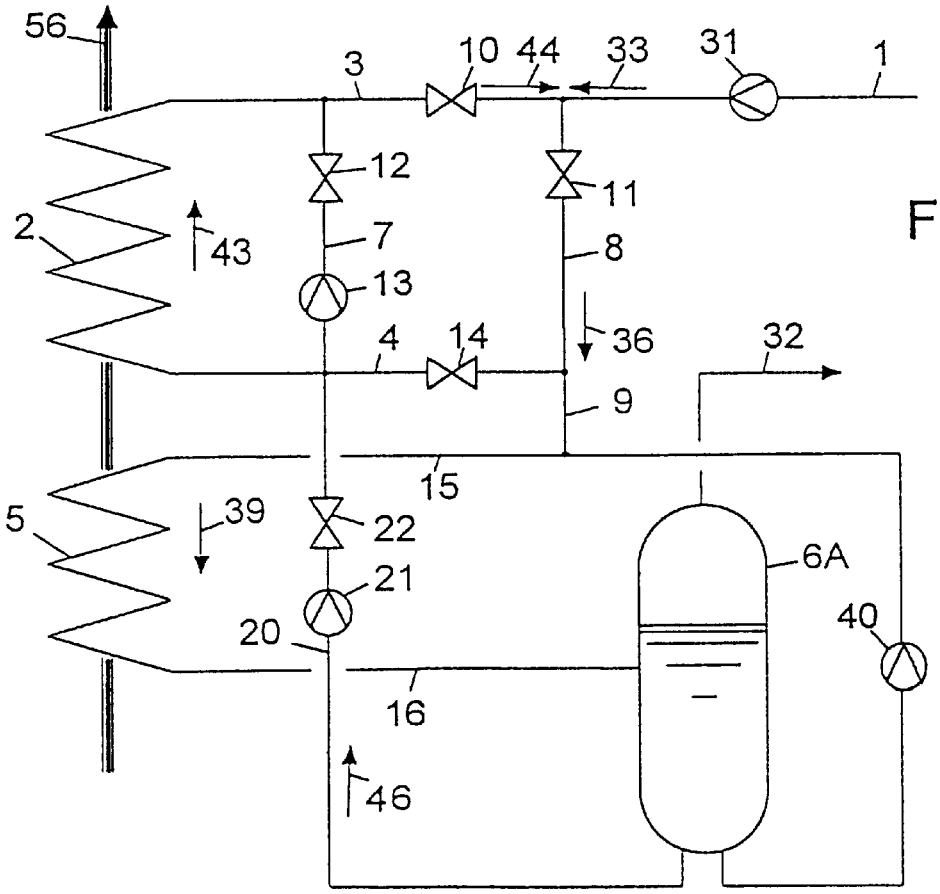
FIG. 5 shows a circuit arrangement in a fourth embodiment of the invention, having a once-through evaporator as a second thermal system.

FIG. 5 shows a circuit arrangement in a fourth embodiment of the invention. This arrangement, in accordance with the exemplary embodiment according to FIG. 2, has a once-through evaporator as second thermal system.

The feed-water line 1 having the feed-water pump 31, through which the feed water flows in the direction of arrow 33, runs to the first thermal system, which is of identical design to the first thermal systems described above and has, in particular, a first heat exchanger 2 having an inlet line 3 and an outlet line 4, a first control element 10, a fourth control element 14, and a recirculation line 7 having a first pump 13 and a third control element 12.

A bypass line 8 having a second control element 11 branches off from the feed-water line 1, which bypass line 8 runs to the outlet line 4. The line section 9 leads as an extension of the outlet line 4 to the second thermal system, in the actual case to the supply line 15. The second thermal system has, in particular, a second heat exchanger, the evaporator 5, to which feed water is admitted via a supply line 15 and which is connected to the separator 6A via the return line 16.

The flow through the second thermal system takes place through the line section 9 into the supply line 15, in the direction of arrow 39 through the evaporator 5 and via the return line 16 into the separator 6A.

Water and steam are separated in the separator 6A. The steam flows via the outlet line 32 to a steam load or superheater. The water separated in the separator is fed back to the evaporator 5 via the supply line 15 having the circulation pump 40.

From the separator 6A, a line 20 having a further pump 21 and a further control element 22 runs to the outlet line 4, in particular to the hot end of the first heat exchanger 2.

For the accelerated raising of the temperature in the first heat exchanger 2, for example during the start-up of the plant, the third control element 12 and the fourth control element 14 are closed. The first pump 13 in the recirculation line 7 is not in operation.

The first control element 10 in the inlet line 3, the second control element 11 in the bypass line 8 and the control element 22 in the line 20 are in the open position; the pump 21 is in operation.

The feed water therefore flows from the feed-water line 1 through the bypass line 8 and the line section 9 in the direction of arrow 36 into the supply line 15 and thus to the second thermal system.

From the separator 6A, water now flows in the direction of arrow 46 through the line 20 to the outlet line 4, i.e. to the hot end of the first heat exchanger 2. Furthermore, the water flows in the direction of arrow 43 through the first heat exchanger 2 to its cold end, then in the direction of arrow 44 through the inlet line 3 to the bypass line 8 in order to flow back with feed water to the second thermal system.

In this embodiment, there is therefore a circuit comprising both thermal systems.

Figure 6:
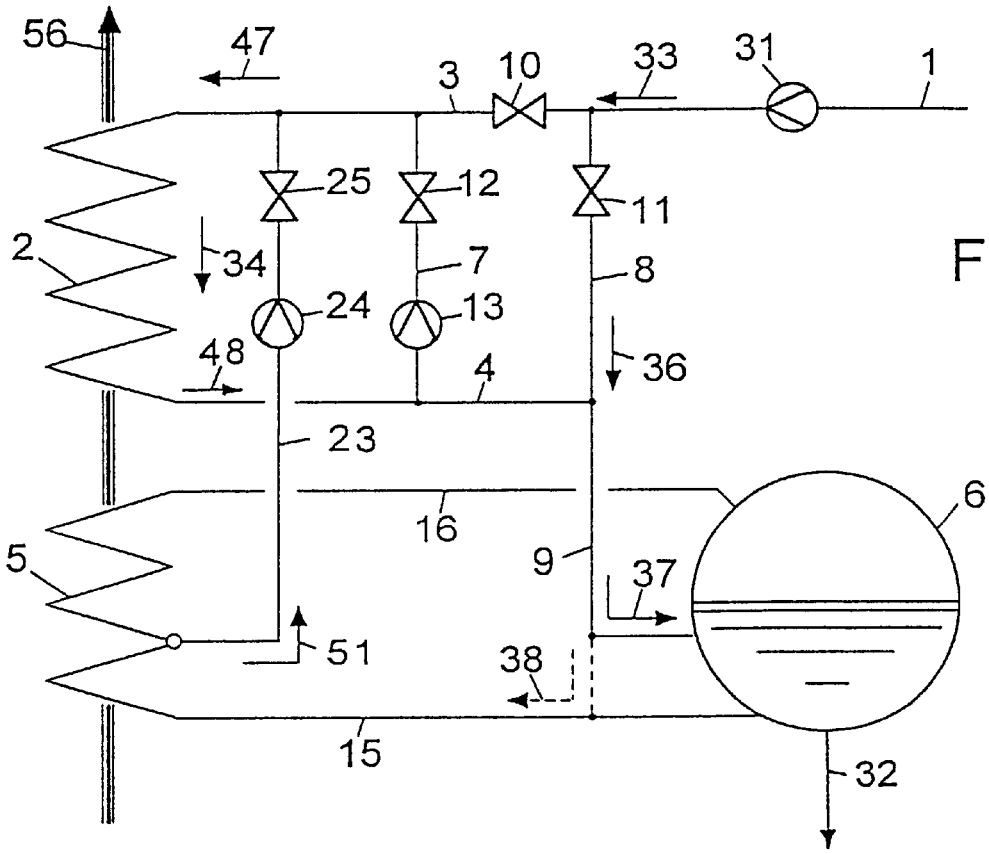
FIG. 6 shows a circuit arrangement in a fifth embodiment of the invention, having a second preheating stage with a tank as a second thermal system.

FIG. 6 shows a fifth embodiment, a second preheating stage having a second heat exchanger 5 and a tank 6 being used as embodiment variant for the second thermal system.

The feed-water line 1 having the feed-water pump 31, through which the feed water flows in the direction of arrow 33, runs to the first thermal system, which again has, in particular, a first heat exchanger 2 having an inlet line 3 and an outlet line 4, a first control valve 10, and a recirculation line 7 having a first pump 13 and a third control element 12.

A bypass line 8 having a second control element 11 branches off from the feed-water line 1, which bypass line 8 runs to the outlet line 4. A line section 9 leads as an extension of the outlet line 4 to the second thermal system, in the actual case to the tank 6. The second thermal system has, in particular, a tank 6 with an outlet line 32 and a second heat exchanger 5, which is connected to the tank 6 via a supply line 15 and a return line 16.

The feed water flowing into the tank 6 via the line section 9 in the direction of arrow 37 may alternatively also flow into the supply line 15, as indicated by dash-lined arrow 38.

In this embodiment, a line 23 having a pump 24 and a control element 25 runs from the second heat exchanger 5 to the cold end of the first heat exchanger 2 or to the inlet line 3.

For the accelerated raising of the temperature in the first heat exchanger 2, for example during the start-up of the plant, the first control element 10 and the third control element 12 are in the closed position, and the first pump 13 is shut down. The second control element 11 and the control element 25 are in the open position, and the pump 24 is in operation.

In this embodiment, the water flows in the direction of arrow 51, through the line 23, further in the direction of arrows 47, 34 and 48 through the first heat exchanger 2 and then together with the feed water, flowing in via the feed-water line 1 and the bypass line 8, via the line section 9, in a first variant, in the direction of arrow 37 into the tank 6 or, in a second variant, in the direction of dash-lined arrow 38 into the supply line 15.

Figure 7:
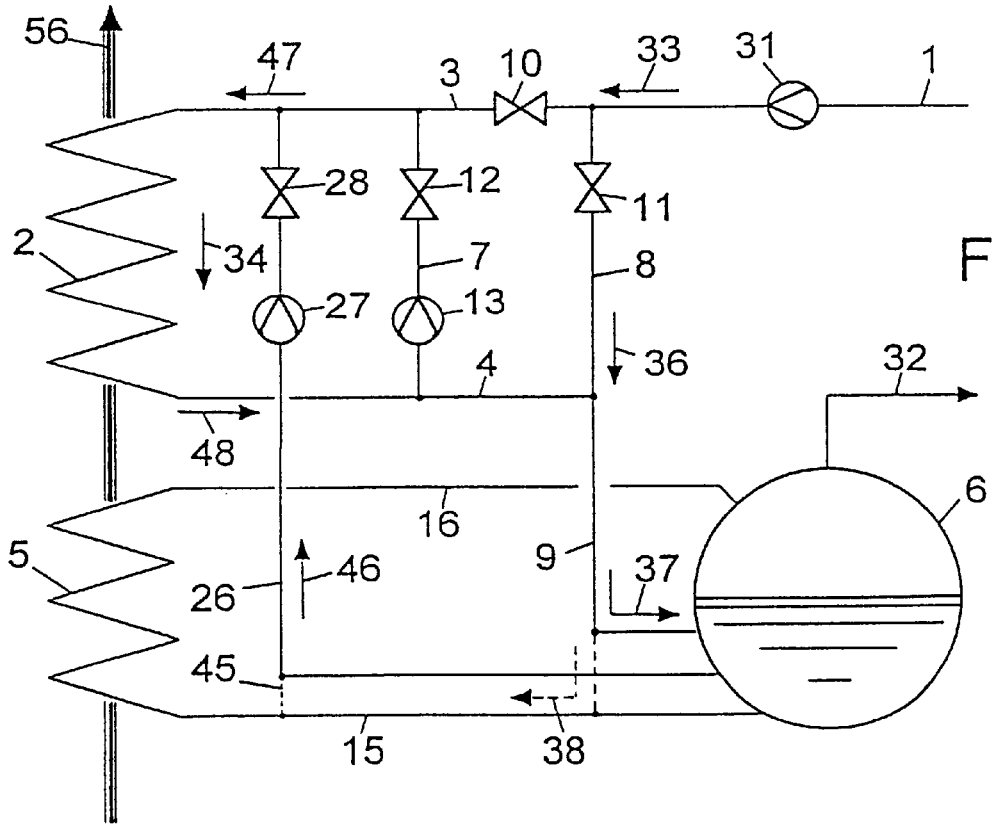
FIG. 7 shows a circuit arrangement in a sixth embodiment of the invention, having a drum circulation evaporator as a second thermal system.

FIG. 7 shows a circuit arrangement in a sixth embodiment of the invention, having a drum circulation evaporator with the steam drum 6 as second thermal system.

The feed-water line 1 having the feed-water pump 31, through which the feed water flows in the direction of arrow 33, runs to the first thermal system, which again has, in particular, a first heat exchanger 2 having an inlet line 3 and an outlet line 4, a first control valve 10, and a recirculation line 7 having a first pump 13 and a third control element 12.

A bypass line 8 having a second control element 11 branches off from the feed-water line 1, which bypass line 8 runs to the outlet line 4. A line section 9 leads as an extension of the outlet line 4 to the second thermal system, in the actual case to the steam drum 6. The second thermal system has, in particular, a steam drum 6 with an outlet line 32 and a second heat exchanger 5, which is connected to the steam drum 6 via a supply line 15 and a return line 16.

The feed water flowing into the steam drum 6 via the line section 9 in the direction of arrow 37 may alternatively also flow into the supply line 15, as indicated by dash-lined arrow 38.

In a first variant, a line 26 having a pump 27 and a control element 28 runs from the steam drum 6 to the cold end of the first heat exchanger 2 or to the inlet line 3.

In a second variant, which is depicted by a dashed line, a line 45, which merges into the line 26, branches off from the supply line 15.

For the accelerated raising of the temperature in the first heat exchanger 2, for example during the start-up of the plant, the first control element 10 and the third control element 12 are closed. The first pump 13 in the recirculation line 7 is shut down.

The second control element 11 in the bypass line 8 and the control line 28 in the line 26 are in the open position, and the pump 27 is in operation.

The feed water therefore flows from the feed-water line 1 through the bypass line 8 and the line section 9 in the direction of arrows 36 and 37 into the steam drum 6 or alternatively into the supply line 15, as indicated by dash-lined arrow 38.

From the steam drum 6, water now flows in the direction of arrow 46 through the line 26 having the pump 27 and the control element 28 to the inlet line 3, i.e. to the cold end of the first heat exchanger 2, in the direction of arrows 47, 34 to the hot end of the first heat exchanger 2, and through the outlet line 4 in the direction of arrow 48 to the line section 9 in order to flow together with the feed water flowing in directly to the steam drum 6 or into the supply line 15.

In a second variant, water can flow out of the supply line 15 via the line 45 into the line 26.

In this embodiment, there is therefore a circuit comprising both thermal systems.

Figure 8:
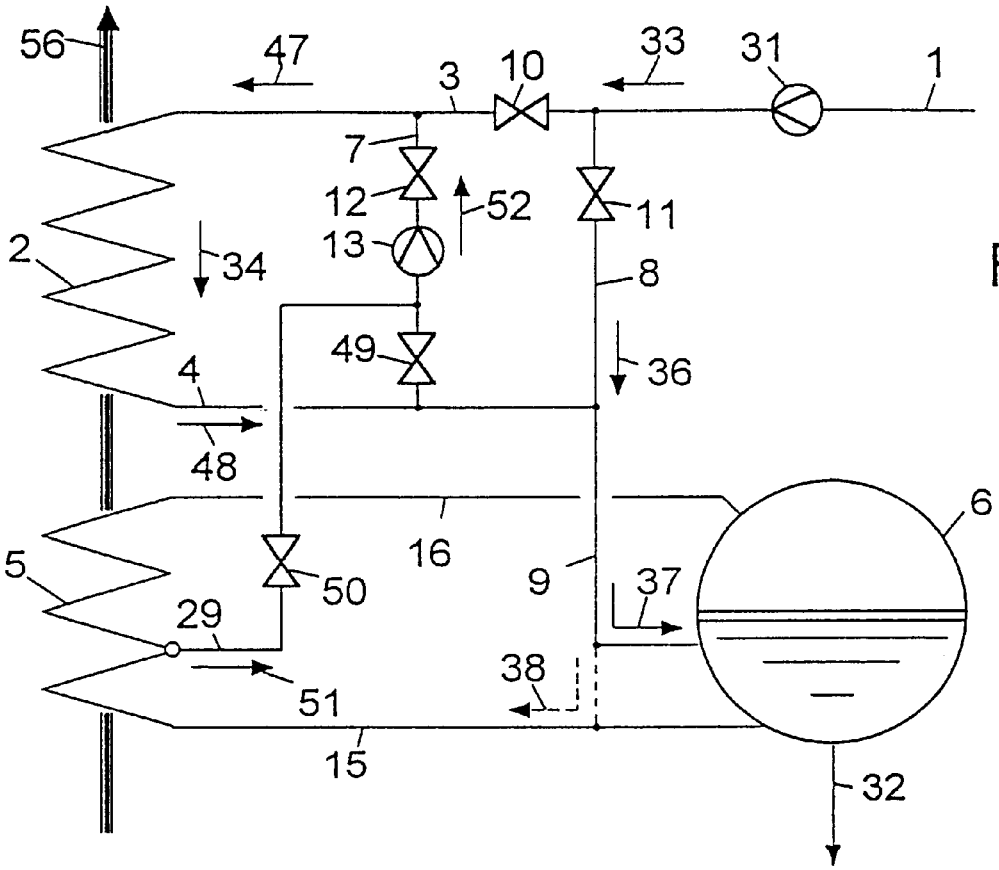
FIG. 8 shows a circuit arrangement in a seventh embodiment of the invention, having a second preheating stage with a tank as a second thermal system.

FIG. 8 shows a circuit arrangement in a seventh embodiment of the invention, a second preheating stage having a second heat exchanger 5 and a tank 6 being used as embodiment variant for the second thermal system.

The feed-water line 1 having the feed-water pump 31, through which the feed water flows in the direction of arrow 33, runs to the first thermal system, which again has, in particular, a first heat exchanger 2 having an inlet line 3 and an outlet line 4, a first control valve 10, and a recirculation line 7 having a first pump 13 and a third control element 12.

A further control element 49 is arranged in the recirculation line 7.

A bypass line 8 having a second control element 11 branches off from the feed-water line 1, which bypass line 8 runs to the outlet line 4. The line section 9 leads as an extension of the outlet line 4 to the second thermal system, in the actual case to the tank 6. The second thermal system has, in particular, a tank 6 with an outlet line 32 and a second heat exchanger 5, which is connected to the tank 6 via a supply line 15 and a return line 16.

The feed water flowing into the tank 6 via the line section 9 in the direction of arrow 37 may alternatively also flow into the supply line 15, as indicated by dash-lined arrow 38.

In this embodiment, a line 29, in which a control element 50 is inserted, branches off from the second heat exchanger 5 and opens into the recirculation line 7 at a point between the control element 49 and the first pump 13.

For the accelerated raising of the temperature in the first heat exchanger 2, for example during the start-up of the plant, the first control element 10 and the control element 49 are closed. The control elements 11, 12 and 50 are in the open position, and the first pump 13 is put into operation.

The feed water therefore flows from the feed-water line 1 through the bypass line 8 and the line section 9 in the direction of arrows 36 and 37 into the steam drum 6 or alternatively into the supply line 15, as indicated by dash-lined arrow 38.

From the second heat exchanger 5, water now flows in the direction of arrow 51 through the line 29 into the recirculation line 7 and in the direction of arrow 52 to the inlet line 3, the cold end of the first heat exchanger 2, through the first heat exchanger 2 to the outlet line 4, the hot end of the first heat exchanger 2, to the line section 9 and together with the feed water, flowing in directly through the bypass line 8, according to arrow 37 into the tank 6 or alternatively according to dash-lined arrow 38 into the supply line 15.

The direction of flow through the first heat exchanger 2 is shown by arrows 47, 34 and 48.

Figure 9:
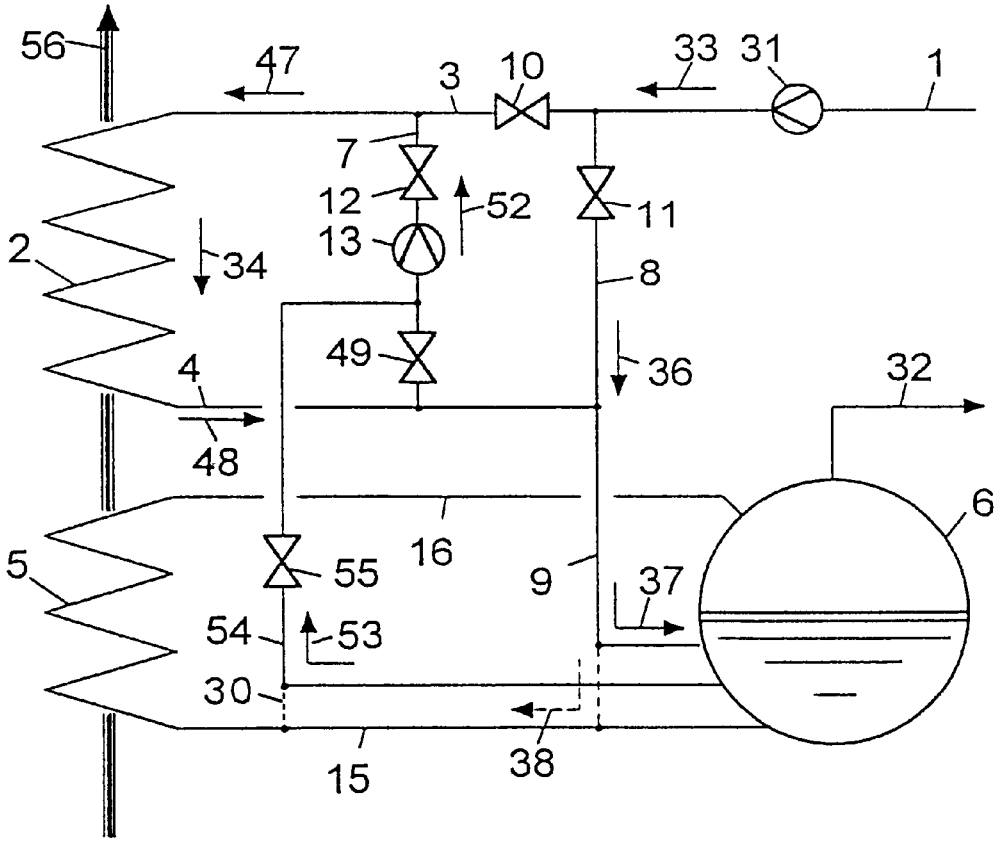
FIG. 9 shows a circuit arrangement in an eighth embodiment of the invention, having a drum circulation evaporator as a second thermal system.

FIG. 9 shows a circuit arrangement in an eighth embodiment of the invention, having a drum circulation evaporator with the steam drum 6 as second thermal system.

The feed-water line 1 having the feed-water pump 31, through which the feed water flows in the direction of arrow 33, runs to the first thermal system, which again has, in particular, a first heat exchanger 2 having an inlet line 3 and an outlet line 4, a first control valve 10, and a recirculation line 7 having a first pump 13 and a third control element 12.

A further control element 49 is arranged in the recirculation line 7.

A bypass line 8 having a second control element 11 branches off from the feed-water line 1, which bypass line 8 runs to the outlet line 4. A line section 9 leads as an extension of the outlet line 4 to the second thermal system, in the actual case to the steam drum 6. The second thermal system has, in particular, a steam drum 6 with an outlet line 32 and a second heat exchanger 5, which is connected to the steam drum 6 via a supply line 15 and a return line 16.

The feed water flowing into the steam drum 6 via the line section 9 in the direction of arrow 37 may alternatively also flow into the supply line 15, as indicated by dash-lined arrow 38.

In a first variant, a line 54, in which a control element 55 is inserted, runs from the steam drum 6 to the recirculation line 7 and opens into the recirculation line 7 at a point between the further control element 49 and the first pump 13.

In a second variant, which is shown by a dashed line, a line 30, which merges into the line 54, branches off from the supply line 15.

For the accelerated raising of the temperature in the first heat exchanger 2, for example during the start-up of the plant, the first control element 10 and the control element 49 are closed. The control elements 11, 12 and 55 are in the open position, and the first pump 13 is put into operation.

The feed water therefore flows from the feed-water line 1 through the bypass line 8 and the line section 9 in the direction of arrows 36 and 37 into the steam drum 6 or alternatively into the supply line 15, as indicated by dash-lined arrow 38.

From the steam drum 6, water now flows in the direction of arrow 53 through the line 54 into the recirculation line 7 and in the direction of arrow 52 to the inlet line 3, the cold end of the first heat exchanger 2, through the first heat exchanger 2 to the outlet line 4, the hot end of the first heat exchanger 2, to the line section 9 and together with the feed water, flowing in directly through the bypass line 8, according to arrow 37 into the steam drum 6 or alternatively according to dash-lined arrow 38 into the supply line 15.

In a second variant, water can flow out of the supply line 15 via the line 30 into the line 54.

The direction of flow through the first heat exchanger 2 is shown by arrows 47, 34 and 48.

The methods described can of course also be used in any desired combinations and chronological sequences.

The invention is in principle independent of the actual design, type of construction, structure and the like of the elements and systems described.

Although this invention has been illustrated and described in accordance with certain preferred embodiments, it is recognized that the scope of this invention is to be determined by the following claims.

What is claimed is:

1. A plant for heating a liquid medium, comprising a feed line for feeding the medium to be heated;

a first thermal system having a first heat exchanger, said first heat exchanger having an inlet line adjoining the feed line, and an outlet line;

a first control element arranged between the feed line and the inlet line;

a bypass line equipped with a second control element running from the feed line to the outlet line;

a line section running from the outlet line to the at least one second thermal system, and wherein the outlet line is connected to the inlet line through a recirculation line having a third control element and a first pump, said recirculation line being arranged parallel to the first heat exchanger.

2. The plant as claimed in claim 1, wherein the at least one second thermal system has a second heat exchanger and a tank for receiving a quantity of the medium in a liquid state, said second heat exchanger is connected to the tank through a supply line running from the tank to the second heat exchanger and through a return line running from the second heat exchanger back to the tank.

3. The plant as claimed in claim 2, wherein a fourth control element is arranged in the outlet line downstream of the point at which the recirculation line branches off from the outlet line.

4. The plant as claimed in claim 2, wherein the line section runs to the tank of the at least one second thermal system.

5. The plant as claimed in claim 2, wherein the line section opens into the supply line.

6. The plant as claimed in claim 2, wherein a circulation pump is arranged in the supply line.

7. The plant as claimed in claim 2, wherein a line opening into the outlet line and having a pump delivering in the direction of the outlet line and a control element is branched off from the second heat exchanger.

8. The plant as claimed in claim 2, wherein a line opening into the outlet line and having a further pump and a further control element is branched off from the tank.

9. The plant as claimed in claim 2, wherein a line opening into the outlet line and having a pump delivering in the direction of the outlet line and a control valve is branched off from the supply line.

10. The plant as claimed in claim 2, wherein a line opening into the inlet line and having a pump delivering in the direction of the inlet line and a control element is branched off from the at least one second heat exchanger.

11. The plant as claimed in claim 2, wherein a line opening into the inlet line and having a pump delivering in the direction of the inlet line and a control element is branched off from the tank.

12. The plant as claimed in claim 2, wherein a line opening into the inlet line and having a pump delivering in the direction of the inlet line and a control element is branched off from the supply line.

13. The plant as claimed in claim 2, wherein a line opening into the recirculation line and having a control element is branched off from the second heat exchanger.

14. The plant as claimed in claim 2, wherein a line opening into the recirculation line and having the control element is branched off from the tank.

15. The plant as claimed in claim 2, wherein a line opening into the recirculation line and having the control element is branched off from the supply line.

16. The plant as claimed in claim 1, wherein the first pump arranged in the recirculation line is designed for delivery of the medium from the outlet line to the inlet line.

17. The plant as claimed in claim 1, wherein the first pump arranged in the recirculation line is designed for delivery of the medium from the inlet line to the outlet line.

* * * * *